United States Patent [19]

Eck et al.

[11] 4,313,336

[45] Feb. 2, 1982

[54] ANCHOR STRUCTURE

[75] Inventors: Leonard F. Eck; Michael Lamb, both of McPherson, Kans.

[73] Assignee: Kansas Jack, Inc., McPherson, Kans.

[21] Appl. No.: 84,874

[22] Filed: Oct. 15, 1979

[51] Int. Cl.[3] ..... B21D 1/14

[52] U.S. Cl. ..... 72/458; 72/705

[58] Field of Search ..... 72/457, 458, 705

[56] References Cited

U.S. PATENT DOCUMENTS

| | | | |
|---|---|---|---|
| 1,676,263 | 7/1928 | Hawkins | 72/705 |
| 2,597,234 | 5/1952 | Elam | 72/705 |
| 3,149,659 | 9/1964 | Bogert, Jr. | 72/705 |
| 3,276,237 | 10/1966 | Transue | 72/705 |
| 4,158,303 | 6/1979 | Horn et al. | 72/705 |

*Primary Examiner*—Lowell A. Larson

*Attorney, Agent, or Firm*—Fishburn, Gold and Litman

[57] ABSTRACT

An anchor structure for exerting a pulling force against a vehicle structural member for straightening operations utilizes a lever arm including a bar member for positioning in an upright relationship and a base member affixed thereto. The bar member has an upper end portion, an intermediate portion and a bottom end portion and is of a rigid material to resist the bending forces applied thereto. The base member is affixed to the bottom end portion and extends laterally therefrom and permits the bar member to rock forwardly and rearwardly on a supportive surface. A lower attachment hook is secured to the lever arm generally at the bottom end portion for connection to a first anchor chain extending away from the lever arm in a direction opposite to a desired direction of pull and prevents movement of the base member outwardly of the first anchor chain. An upper attachment hook is secured to the lever arm at the intermediate portion for connection to a pulling chain extending away from the lever arm in a desired direction of pull whereby a pulling force is exerted on the lever arm to swing the upper end portion toward the pulling chain. The upper end portion is engaged with a vehicle structural member and exerts a pulling force thereon to either anchor a vehicle or to straighten bent vehicle structural members depending upon the extent of pulling force applied.

3 Claims, 5 Drawing Figures

ANCHOR STRUCTURE

This invention relates to equipment used in straightening vehicle frames and bodies and in particular to an anchor structure used therewith.

Vehicle frames and bodies may become mis-shapened or otherwise damaged through collisions, accidents and the like. All vehicles employ a chassis or frame which is a rigid structure that attaches and supports the vehicle running gear, power train and body assemblies. The frame may be of independent type whereby the frame does not depend upon the body or other structures for its strength or may be of dependent type wherein the frame does depend upon the body or other structures for its strength. Different types of frame construction include the conventional type which is an independent frame having box or open flange side rails and cross members connecting the side rails together. The body is bolted to the frame. Yet another independent type of frame construction is the platform frame in which the frame is constructed of sheet metal panels of varying gauges to form a solid unit. Still another type of frame is the unitized frame which is a dependent type of frame constructed of sheet metal parts and panels of varying gauges to form a solid unit. The vehicle body is welded to the frame and forms a single unit therewith.

Regardless of the type of frame, frame damage can occur thereto as a result of a collision or the like, the various types of damage descriptively known as diamond, twist, sag, sway, and local damage. A repairman must correctly evaluate the existing frame damage that the vehicle has sustained and should, by the use of various pulling devices, pull the frame damage out or straighten the damaged frame members in the direction and sequence that the damage occurred. Typically, substantial force is applied to the damaged or bent frame members to straighten same and the vehicle must be secured against movement so as to generally resist the pulling movement and thereby localize the pulling force applied to the damaged members. Usually, the vehicle is secured against movement by various chains wrapped around frame members or the like. There is often insufficient room to wrap a chain around, for example, the side rails of a ladder conventional frame. Moreover, in the example of a side collision, a side rail may be pushed inwardly and must be straightened. Hereagain, there is often insufficient room to wrap a chain around the damaged section of the rail and exert a pulling force.

The principal objects of the present invention are: to provide a tool for use in vehicle straightening operations; to provide such a tool comprising a lever arm for exerting force against a vehicle structural member; to provide such a lever arm to which a pulling force is applied to either anchor in a vehicle structure member or to straighten a bent vehicle structural member; to provide such a lever arm having a upright bar member and a base member extending laterally from the bar member and providing a seat or base upon which the bar member rocks and exerts a force at an upper end thereof spaced from the base member; to provide such a lever arm having spaced upper and lower attachment hooks for connection of elongate tension members, such as chains, to anchor the base member and exert a pulling force on the bar member; and to provide such a tool which is relatively inexpensive, highly reliable in use and well adapted for its intended purpose.

Other objects and advantages of this invention will become apparent from the following description taken in connection with the accompanying drawings wherein is set forth by way of illustration and example, a certain embodiment of this invention.

Figure 1:
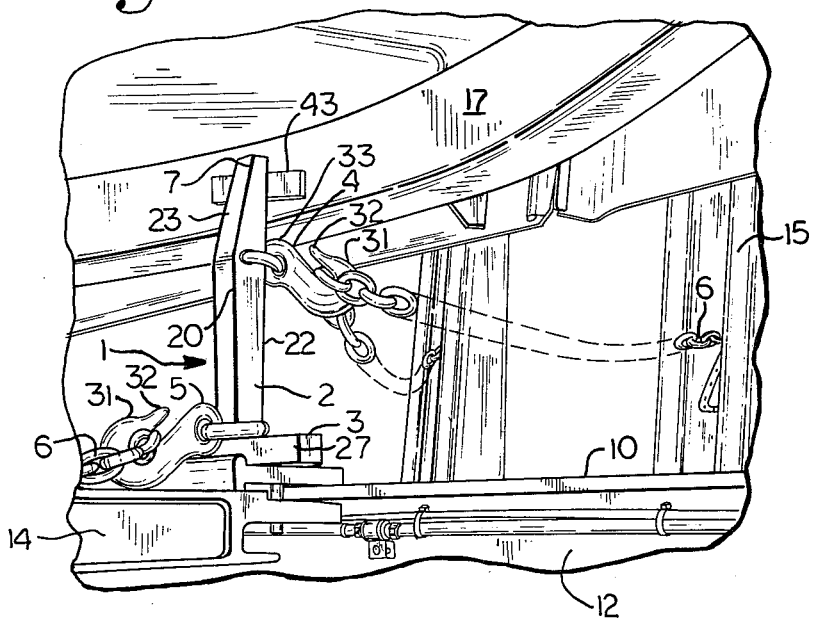
FIG. 1 is a side perspective view of an anchor structure embodying this invention and which is shown in an in use position exerting force against the vehicle structural member.

As required, a detailed embodiment of the present invention is disclosed herein, however, it is to be understood that the disclosed embodiment is merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Referring more in detail to the drawings:

The reference numeral 1 generally indicates an anchor structure of rigid and strong material such as steel embodying the present invention and having an upright bar member 2 secured to and extending upwardly from a base member 3 projecting laterally therefrom and permitting the bar member 2 to rock forwardly and rearwardly on a supportive surface as force is applied thereto. The anchor structure 1 has upper and lower attachment means 4 and 5 which may be for connection of tension members 6 thereto which apply an anchoring force when connected to the lower attachment means 5 and a pulling force when connected to the upper attachment means 4 whereby an upper portion 7 of the bar member 2 engages a vehicle structural member and applies a force thereto.

Figure 2:
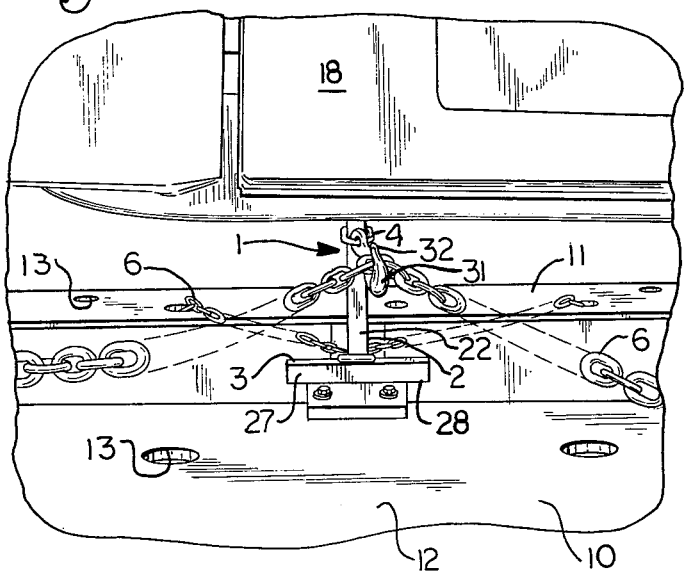
FIG. 2 is a front perspective view of the anchor structure in an in use position.
Figure 3:
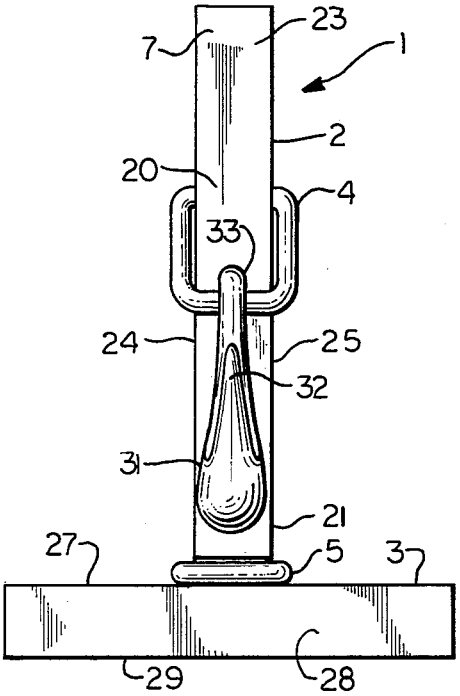
FIG. 3 is a front elevational view of the anchor structure.
Figure 4:
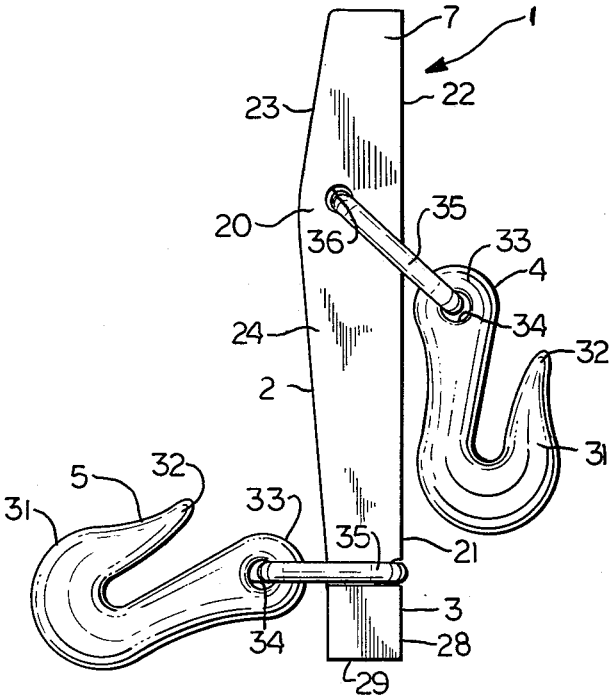
FIG. 4 is a side elevational view of the anchor structure.
Figure 5:
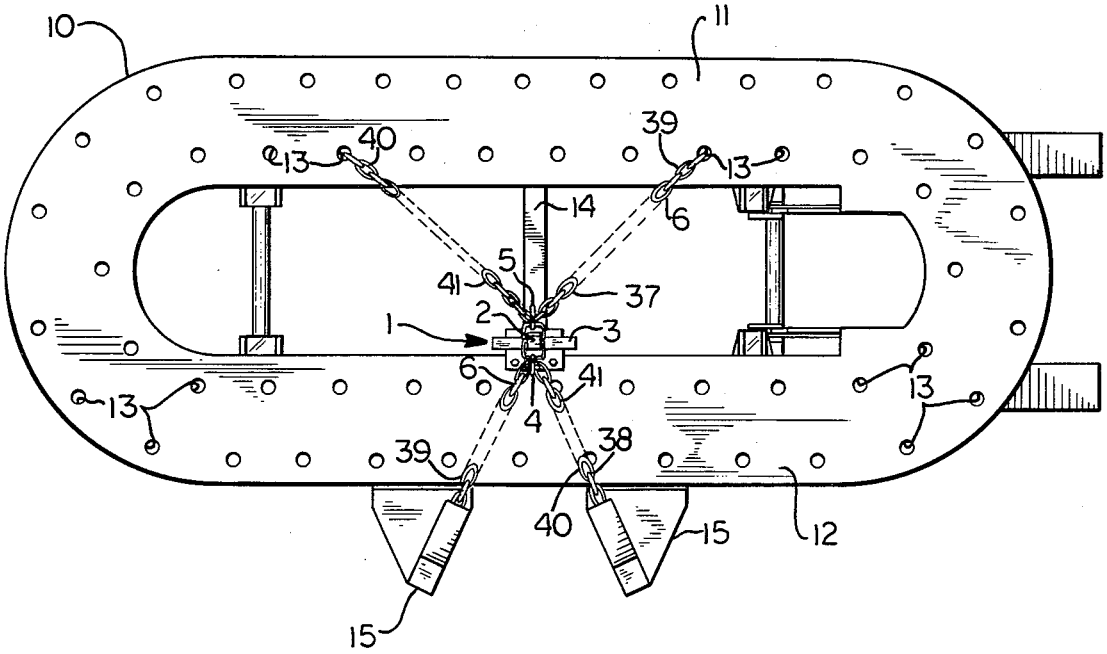
FIG. 5 is a plan view showing the anchor structure positioned upon a rack structure for conducting vehicle frame and body straightening operations and showing various tension members connected to the anchor structure.

In the illustrated example, FIGS. 1 and 2 the anchor structure 1 is shown positioned upon a supportive surface of a rack structure 10 having spaced side rail members 11 and 12 having a plurality of receptacles 13 therein having suitable means for removably securing an end of a tension member 6 therein. Although the rack structure 10 is shown in the illustrated example, the anchor structure 1 may be used in conjunction with a supportive surface such as a shop floor of reinforced concrete and having a plurality of receptacles therein such as shown in U.S. Pat. No. 4,067,222 which discloses a receptacle having a liner member for securing a tension member such as a chain thereto.

The rack structure 10 includes a cross member 14 extending between the side rail members 11 and 12 and the anchor structure 1 is shown positioned atop the juncture of the cross member 14 with the side rail member 12. A plurality of pulling force applying means 15 are movably positioned around the perimeter of the rack structure 10 and include internal means such as shown in U.S. Pat. Nos. 3,566,667 and 3,612,482 whereby one of the tension members 6 is extended therefrom and connected to one of the attachment means 4 and 5 to exert a pulling force thereon.

The anchor structure 1, depending upon the amount of pulling force applied thereto, exerts either an anchoring or a bending force to a vehicle structural member 17 which forms a part of a chassis or frame of a vehicle 18. In the illustrated example, the vehicle structure member 17 is a side rail of a vehicle having a conventional ladder frame and wherein it is desired to apply a force to the side rail in order to anchor same and accomplish a pull of vehicle structural members opposite or spaced from the subject structural member 17. Alternatively, the structural member 17 may be damaged or bent inwardly, as from a sideward collision, and it is necessary to pull the structural member 17 outwardly or in the direction by which the damage entered and thereby straighten the structural member 17. There is often insufficient room to wrap chains or the like around the structural member 17 to exert a pull thereon or to provide an anchoring arrangement for the structural member and the anchor structure 1 provides an offset pulling or anchoring arrangement for the structural member 17.

In the illustrated example, the upright bar member 2 of the anchor structure 1 includes the upper portion 7, an intermediate portion 20 and a bottom end portion 21. The bar member 2 has front and rear surfaces 22 and 23 and opposite side surfaces 24 and 25. Preferably, the intermediate portion 20 is thickened from front to rear relative to the remainder of the bar portion 2 for receipt of the upper attachment means 4 as described below.

The base member 3, in the illustrated example, is secured, as by welding to the bottom end portion 21 in a perpendicular orientation to the long axis of the bar member 2. The base member 3 extends laterally outward from the bottom end portion 21 and is elongate in shape with opposite arm portions 27 and 28 providing a bottom surface 29 for contact with a supportive structure, such as the rack structure 10.

The respective upper and lower attachment means 4 and 5 include a hook member 31 having a narrow tip end 32 and an eye end 33 having an aperture or eye 34 therethrough through which a link 35 extends. In the illustrated example, the link 35 of the lower attachment means 5 extends around the bottom end portion 21 and is secured thereto, as by welding. The link 35 of the upper attachment means 5 extends through a bore 36 in the intermediate portion 20 whereby both the upper and lower attachment means 4 and 5 are swingably secured to the bar member 2.

In use, the anchor structure 1 is positioned generally under the vehicle structural member 17 to which force is to be applied, FIG. 1 and is connected as described below to tension members 6. In the illustrated example, the tension members 6 are chains 37 and 38 having opposite ends 39 and 40 and a midportion 41. The chain 37 is attached to the lower attachment means 5 whereby opposite ends 39 and 40 thereof are engaged in spaced receptacles 13 and positioned in back of or to the rear of the anchor structure 1 whereby the chain 37 restricts or prevents forward movement of the bottom end portion 21 of the bar member 2 and serves as an anchor therefor. The midportion 41 of the chain 37 is removably received in the hook member 31. The chain 38 has opposite ends 39 and 40 thereof attached to spaced force applying means 15 positioned toward the front of the anchor structure 1 and a midportion 41 of the chain is received within the upper hook member 31 whereby pulling force is applied to the anchor structure 1 to swing the bar member 2 forwardly. When pulling force is applied to the bar member 2, the bottom end portion 21 is restricted from movement toward the force applying means 15 by the connection of the chain 37 while the upper portion 7 of the bar member 2 is free to swing forwardly or in the direction of the force applied by the means 15, thereby enabling the anchor structure 1 to be variously used as an anchor or for straightening bent portions of the vehicle structure member 17. In the example shown in FIG. 1, the upper portion 7 engages the structural members 17 to apply force thereto. To extend the application of force or spread out the point at which the most force is applied, a pad or plate 43 of deformation resistant material, such as steel or the like, is positioned between the front surface 22 of the bar upper portion 7 and the structural member 17.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. An anchor structure for exerting force against vehicle structural members during straightening operations thereof and comprising:

(a) a generally upstanding bar member having an upper end portion, an intermediate portion and a bottom end; said bar member being of a rigid material to resist bending forces applied thereto;

(b) a base member rigidly secured to said bottom and extending laterally therefrom in a transverse direction to a direction of pull for resting upon a supportive surface, said base member being elongate in shape to form an inverted T-shaped structure with said bar member whereby said bar member and said base member rock forwardly and rearwardly on said supportive surface;

(c) a lower attachment hook swingably secured to said bar member at said bottom end and upward of said base member and extending therefrom generally perpendicular to a long direction of said base member;

(d) an upper attachment hook swingably secured to said bar member at said intermediate portion and extending therefrom generally perpendicular to the long direction of said base member and opposite to the direction of extension of said lower attachment hook;

(e) a first elongate tension member connected to said lower attachment hook and extending away therefrom in a direction opposite to the desired direction of pull, said first tension member having a remote end for securing to an anchor spaced from said bar member and preventing outward movement of base member away from said anchor; and (f) a second elongate tension member connected to said upper attachment hook and extending away therefrom in the desired direction of pull, said tension member having a remote end portion for securing to a pulling means spaced from said bar member whereby said pulling means is operable to exert a pulling force on said second tension member and swing said bar member upper end portion theretoward, said upper end portion being engageable against a vehicle structural member to exert a pulling force thereon.

2. An anchor structure for exerting a pulling force against a vehicle structural member for straightening operations and comprising:

(a) a lever arm including a bar member for positioning in a generally upstanding relationship and a base member rigidly affixed thereto for resting upon a supportive surface;

(b) said bar member having an upper end portion, an intermediate portion, a bottom end portion and being of a rigid material to resist bending forces applied thereto;

(c) said base member extending laterally from said bottom end portion in a transverse direction to a direction of pull whereby said bar member and said base member rock forwardly and rearwardly on said supportive surface;

(d) a lower attachment means secured to said lever arm generally at said bottom end portion for anchoring said lever arm; and (e) an upper attachment means secured to said lever arm generally at said intermediate portion for connection to a tension member extending away from said lever arm in the desired direction of pull whereby a pulling force is exerted on said lever arm to swing said upper end portion toward said tension member, said upper end portion being engageable against a vehicle structural member to exert a pulling force thereon;

(f) said upper and lower attachment means respectively including hook members swingably secured to said bar member at said bottom end portion and said intermediate portion, said hook members being adapted for engagement with first and second tension members for exerting force on said lever arm.

3. The anchor structure set forth in claim 2 wherein:

(a) said bar member is elongate;

(b) said lower attachment means extends from said bar member generally perpendicular to a long direction of said base member; and (c) said upper attachment means extends from said bar member generally perpendicular to the long direction of said base member and opposite to a direction of extension of said lower attachment means.

* * * * *